United States Patent [19]

Pryor

[11] Patent Number: 4,472,224

[45] Date of Patent: Sep. 18, 1984

[54] OPENING OF CIGARETTE FILTER TOW AND JET THEREFORE

[75] Inventor: James W. Pryor, Winston-Salem, N.C.

[73] Assignee: R. J. Reynolds Tobacco Company, Winston-Salem, N.C.

[21] Appl. No.: 437,653

[22] Filed: Oct. 29, 1982

[51] Int. Cl.[3] ..... D04H 3/07; D01D 1/02; D02J 11/18

[52] U.S. Cl. ..... 156/180; 28/283; 156/441; 493/44

[58] Field of Search ..... 156/180, 441, 166, 152; 19/667, 657; 28/283, 282, 273, 271; 493/44, 42, 49, 48; 239/590.3, 597, 598, 601

[56] References Cited

U.S. PATENT DOCUMENTS

| | | | |
|---|---|---|---|
| 2,966,198 | 12/1960 | Wylde | 154/1.7 |
| 3,099,594 | 7/1963 | Caines et al. | 156/152 |
| 3,157,536 | 11/1964 | Caines | 118/225 |
| 3,262,178 | 7/1966 | Aspy, Jr. et al. | 28/1 |
| 3,262,181 | 7/1966 | Hawkins et al. | 28/72 |
| 3,282,768 | 11/1966 | Caines et al. | 156/441 |
| 3,297,506 | 1/1967 | Pannill, Jr. et al. | 156/152 |

*Primary Examiner*—Michael W. Ball
*Attorney, Agent, or Firm*—Herbert J. Bluhm

[57] ABSTRACT

An improved jet device for treating a continuous, multi-filament filter tow is disclosed wherein discharge means affixed to the exit end of the jet tube of the device are modified to present a smooth streamlined surface to the moving filter tow and to prevent accumulation therein of liquid addendum dislodged from the filter tow.

12 Claims, 2 Drawing Figures

OPENING OF CIGARETTE FILTER TOW AND JET THEREFORE

TECHNICAL FIELD

This invention relates to the processing of a continuous, multifilament filter tow in connection with a filter rod forming operation.

BACKGROUND ART

The manufacture of cigarette filters from a continuous, multifilament filter tow generally involves processing steps which include separation of the individual filaments (i.e., "opening up" of the filter tow), the application of plasticizer and other additives to the opened up tow and the formation of a continuous filter rod from the plasticized filter tow. The uniformity and filtering characteristics of the resulting filter rod are largely determined by the effectiveness of these tow processing steps. Thus, there is a substantial amount of prior art which is directed to methods and apparatus for transforming filter tow into cigarette filters having predictable smoke filtration characteristics.

One of the prior art methods for converting filter tow into a filter rod involves passage of the tow through a circular jet where the tow is subjected to tension created by a gaseous fluid flowing through the circular jet in the direction of the advancing tow. U.S. patents disclosing methods and apparatus relating thereto include U.S. Pat. Nos. 3,099,594, 3,262,178, 3,262,181, 3,282,768 and 3,297,506.

In converting the filter tow into a filter rod, a suitable plasticizer is applied to the tow in such a way that the characteristics of the resulting filter rod are more or less uniform. In U.S. Pat. Nos. 3,099,594 and 3,282,768 (FIGS. 4 and 5) there is taught a method for injecting plasticizer into the moving stream of gaseous fluid so that application of plasticizer to the filter tow takes place in the turbulence created by the moving gaseous fluid. Distribution of plasticizer on the individual filaments of the filter tow in this method depends on the interaction between the gaseous fluid, the filter tow, the plasticizer and the circular jet in which the various components are temporarily confined. It has been found, however, that introduction of plasticizer into the stream of gaseous fluid does not result in uniform distribution of plasticizer on the filter tow. Rather, the plasticizer has a tendency to remain on the outer peripheral layers of filaments in the filter tow as it moves toward the tow exit end of the jet. Furthermore, a portion of the injected plasticizer emerges from the jet in the form of droplets if the quantity of injected plasticizer is not carefully controlled. Thus, the addition of plasticizer via injection into the moving stream of gaseous fluid has never provided completely satisfactory operation. Consequently, the commercial processing of cigarette filter tow has generally employed alternative methods involving the application of plasticizer to a flattened, spread band of tow by spray means or wick type applicators. Such alternative methods are disclosed, for example, in U.S. Pat. Nos. 3,157,536, 4,132,189 and 4,313,974.

BRIEF SUMMARY OF THE INVENTION

This invention provides an improved method and apparatus for processing a continuous, multifilament filter tow in connection with the manufacture of cigarette filters from the tow.

It is a principal object of this invention to provide an improved blooming method and apparatus for a continuous, multifilament filter tow which minimizes the buildup of tow additives on internal surfaces of the blooming device.

It is a further object of this invention to provide an improved method and apparatus for processing filter tow which results in more uniform distribution of additives on the filter tow.

Other objects and advantages of the invention will be apparent from the detailed description which follows.

DETAILED DESCRIPTION OF THE INVENTION

One of the commercial methods for converting a continuous, multifilament filter tow into a compact rod suitable for use as a cigarette filter involves passage of the filter tow through a jet device which loosens and blooms the tow before it is subsequently formed into a filter rod. The formation of a satisfactory filter rod requires that the filter tow be treated with a liquid plasticizer prior to the filter rod forming step. Since the filter tow is subjected to considerable tension generated by a gaseous fluid passing through the jet device, it is important to consider the manner in which the plasticizer is applied to the filter tow in order that excessive loss of plasticizer is avoided.

Figure 1:
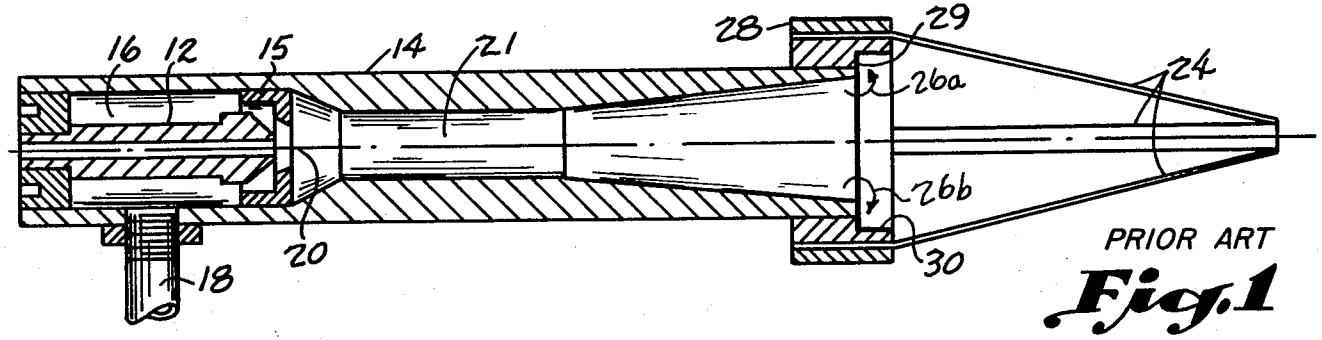
PRIOR ART Fig. 1
FIG. 1 is a cross-sectional view of a conventional jet device for blooming filter tow.

A cross-sectional view of a conventional jet device is shown in FIG. 1 wherein filter tow is introduced into a tubular entrance member 12 that is concentrically positioned within the entrance end of jet tube 14 which has an elongated passageway 21 extending through the tube that is generally circular in cross sectional configuration with a diameter that is somewhat larger than that of tubular entrance member 12. Positioned within elongated passageway 21 adjacent the exit end of tubular entrance member 12 is orifice plate 15. Annular chamber 16 is provided with means for supplying high velocity air or other suitable gaseous fluids thereto at elevated pressures via conduit 18. The air or other gaseous fluid passes through orifice 20 in orifice plate 15 and then into elongated passageway 21 which terminates at discharge means 28 affixed to the exit end of jet tube 14. Filter tow introduced into tubular entrance member 12 passes through orifice 20 and elongated passageway 21 under the influence of the rapidly moving stream of air or other gaseous fluid. When the filter tow and gaseous fluid reach the exit end of jet tube 14, the significantly greater inside diameter and short length of discharge means 28 as compared with the adjacent diameter and length of elongated passageway 21 permits a sudden radially outward movement of the filter tow and gaseous fluid. The continued outward and forward movement of the bloomed tow is partially restrained by a plurality of resilient fingers 24 attached to the discharge means.

Figure 2:
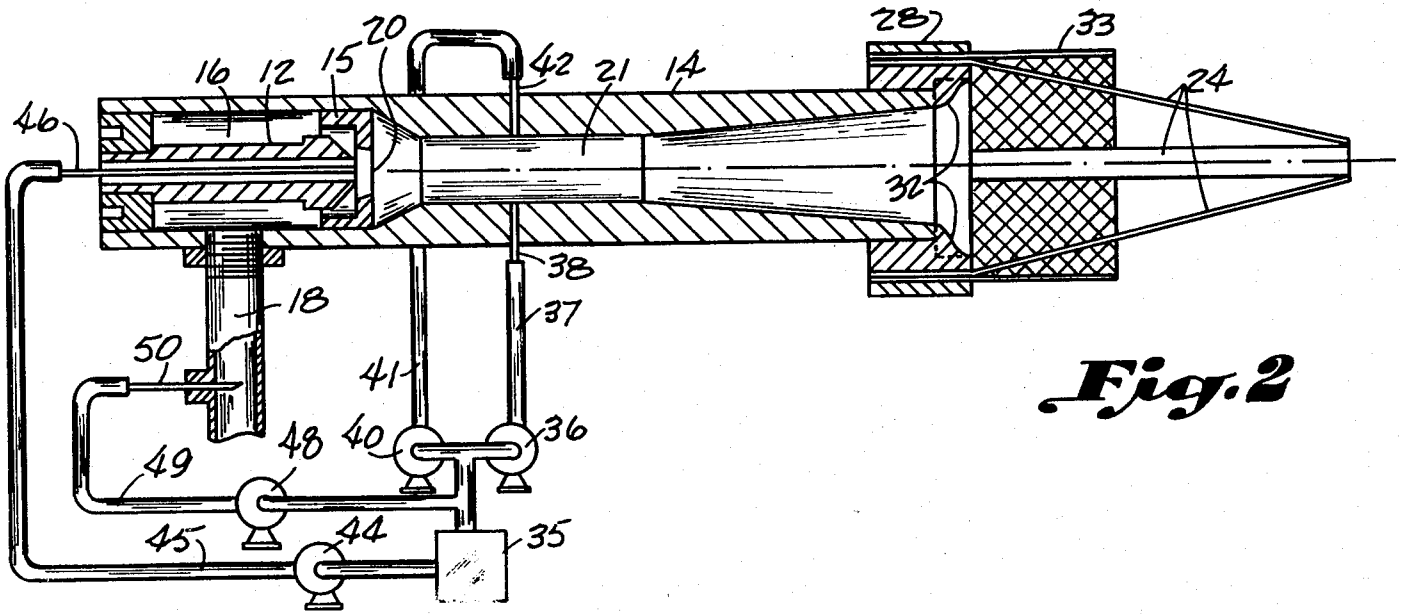
FIG. 2 is a combination side elevation view and cross-sectional view of a filter tow blooming jet device modified in accordance with the present invention.

In the conventional processing of cigarette filter tow, plasticizer is applied to the tow before the tow is introduced into the blooming jet as shown, for example, in FIG. 2 of U.S. Pat. No. 3,297,506. Although one of the functions of the blooming jet is to redistribute plasticizer on the tow, in actual practice very little redistribution of plasticizer occurs. If excess plasticizer has been applied to portions of the filter tow, some of the plasticizer is dislodged from the tow and migrates to the exit end of jet tube 14 where it accumulates on the inner surface of discharge means 28 in the areas indicated generally by arrows 26*a* and 26*b* in FIG. 1. The accumulated plasticizer then moves toward the lower side of discharge means 28 (i.e., the area indicated by arrow 26*b*) under the influence of gravity and emerges from discharge means 28 in the form of a steady stream of droplets. Since the accumulated plasticizer dripping from discharge means 28 may contact a portion of the filter tow as it is bloomed, the resulting filter rod formed from the tow may have undesirable localized deposits of plasticizer which can affect the uniformity of the filters cut from the filter rod. The accumulation of plasticizer in discharge means 28 may also occur when plasticizer is applied to the tow by injection probes terminating at points within the jet tube such as the arrangement shown in FIG. 5 of U.S. Pat. No. 3,099,594.

It has now been discovered that the accumulation of plasticizer in the discharge means of a conventional blooming jet device can be eliminated or greatly minimized by modifications in accordance with the present invention as shown in FIG. 2. The various parts of the modified jet device which are similar to those of the conventional device shown in FIG. 1 have been assigned the same numbers. The principal modification made involves discharge means 28 which has been provided with fillet 32. Fillet 32 is located at the junction of surfaces 29 and 30 (see FIG. 1) and provides a smooth streamlined surface for the transition from the inside wall of the abutting exit end of the jet tube to the inside wall of discharge means 28. The presence of fillet 32, which connects the inside wall of the jet tube with the inside wall of the discharge means, prevents the accumulation of plasticizer in discharge means 28 even when plasticizer is applied to the filter tow as the tow passes through the jet device. For example, plasticizer from supply tank 35 may be injected into elongated passageway 21 via probes 38 and 42 and their respective associated conduits 37 and 41 and pumps 36 and 40. Alternatively or in addition, plasticizer may be injected at orifice 20 via pump 44, conduit 45 and probe 46. Plasticizer may also be injected via pump 48, conduit 49 and probe 50 into conduit 18 which supplies a gaseous fluid medium to the jet device. Plasticizer distribution on the filter tow may be somewhat influenced by the injection probe locations selected. For example, injection through probes 38, 42 and 50 results in plasticizer being distributed primarily on the filaments located in the outer periphery of the bundle of filaments. Obviously, the various conduits through which the plasticizer flows may be provided with valves for controlling the flow of plasticizer to the selected injection probe locations. Regardless of the particular point selected for introducing plasticizer into the jet device, excessive amounts of plasticizer should be avoided. Generally, plasticizer amounts in excess of 14 percent by weight based on the weight of the filter tow will produce unsatisfactory filter elements. Preferably, plasticizer amounts in the range of 5 to 10 percent by weight based on the filter tow weight are used. When plasticizer amounts of about 7 percent or more are applied, two or more points of injection should be employed to improve plasticizer distribution in the filter tow.

An optional feature that is preferably used with the modified discharge means shown in FIG. 2 is a tow confining, cylindrical sleeve 33 axially aligned with and attached to discharge means 28. Sleeve 33 is constructed of screen wire, perforated metal or plastic or other suitable porous material that is essentially rigid. Sleeve 33 restricts the radially outward movement of the filter tow in the areas between resilient fingers 24 but allows at least a portion of the gaseous fluid to escape through the sleeve as the tow is bloomed by the expanding gaseous medium. It is important that the inner surface of sleeve 33 be free of any sharp protrusions which might interfere with the forward movement of the tow.

Although the present invention is particularly useful in connection with the application of plasticizer to filter tow, it is also advantageous for applying other liquid addenda to filter tow. For example, a flavorant such as menthol may be applied to the filter tow using a suitable solvent medium such as ethanol, propylene glycol, diethylene glycol, triacetin, etc. Other flavoring materials may be similarly applied.

It is apparent that other modifications to this invention can be made without departing from the spirit and scope of the appended claims.

What is claimed is:

1. A process for treating a continuous, multifilament filter tow in connection with the manufacture of filter elements therefrom which comprises introducing the filter tow into a jet device that includes (a) a jet tube having entrance and exit ends with an elongated passageway generally circular in cross-sectional configuration extending through the jet tube, said entrance and exit ends being adapted to receive and discharge, respectively, said filter tow, (b) means for establishing and maintaining a high velocity stream of gaseous fluid through the jet device in the direction of the exit end of the jet tube, and (c) discharge means affixed to the exit end of the jet tube, said discharge means being substantially circular in cross-sectional shape with an inside diameter significantly greater than that of the exit end of the jet tube to permit a sudden radially outward movement of the gaseous fluid and the filter tow as they emerge from the exit end of the jet tube, subjecting the filter tow while in said jet device to tension created by a high velocity stream of gaseous fluid moving through the jet device in co-current flow with the filter tow, applying a liquid addendum to the filter tow as it moves through the jet tube, presenting a smooth streamlined surface to the filter tow as it moves from the jet tube into the discharge means, restricting the radially outward movement of the filter tow by tow confining means attached to the discharge means as the filter tow emerges from the discharge means and withdrawing treated filter tow from said tow confining means for further processing into filter elements.

2. A process according to claim 1 wherein the liquid addendum applied to the filter tow comprises a plasticizing agent.

3. A process according to claim 1 wherein the liquid addendum applied to the filter tow comprises a flavoring agent.

4. A process according to claim 1 wherein restriction of the radially outward movement of the filter tow as it emerges from the discharge means is effected by a porous, essentially rigid cylindrical sleeve which allows at least a portion of the gaseous fluid to escape through said sleeve.

5. A process according to claim 1 wherein the liquid addendum is applied by injecting the addendum directly into the jet tube of the jet device.

6. A process according to claim 1 wherein the liquid addendum is applied by injecting the addendum into the stream of gaseous fluid prior to introducing said fluid into the jet tube of the jet device.

7. In a process for manufacturing a filter rod from a continuous, multifilament filter tow wherein the filter tow is passed through a jet device designed to subject the filter tow to tension created by a high velocity stream of gaseous fluid moving through the jet device in co-current flow with the filter tow and applying a liquid addendum to the filter tow as it moves through the jet device, which jet device includes (a) a jet tube having entrance and exit ends with an elongated passageway generally circular in cross-sectional configuration extending through the jet tube, said entrance and exit ends being adapted to receive and discharge, respectively, said filter tow, (b) means for establishing and maintaining a high velocity stream of gaseous fluid through the jet device in the direction of the exit end of the jet tube, and (c) discharge means affixed to the exit end of the jet tube, said discharge means being substantially circular in cross-sectional shape with an inside diameter significantly greater than that of the exit end of the jet tube to permit a sudden radially outward movement of the gaseous fluid and the filter tow as they emerge from the exit end of the jet tube, the improvement which comprises providing a fillet disposed on the inside wall of the discharge means in abutting relationship to the exit end of the jet tube, said fillet being designed to present a smooth streamlined surface connecting the inside wall of the exit end of the jet tube with the inside wall of the discharge means for preventing the accumulation of liquid addendum dislodged from the filter tow.

8. The improvement of claim 7 which additionally includes providing a porous, cylindrical sleeve axially aligned with and attached to said discharge means for restricting radially outward movement of the filter tow as it emerges from the discharge means and allowing at least a portion of the gaseous fluid to escape through said sleeve.

9. A jet device for treating a continuous, multifilament filter tow in connection with the manufacture of filter elements therefrom which comprises (a) a jet tube having entrance and exit ends with an elongated passageway substantially circular in cross-sectional shape extending through the tube, said entrance and exit ends being adapted to receive and discharge, respectively, said filter tow, (b) means for establishing and maintaining a high velocity stream of gaseous fluid through the jet device in the direction of the exit end of the jet tube, (c) discharge means affixed to the exit end of the jet tube, said discharge means being substantially circular in cross-sectional shape with an inside diameter significantly greater than that of the exit end of the jet tube to permit a sudden radially outward movement of the gaseous fluid and the filter tow as they emerge from the exit end of the jet tube, and (d) a fillet disposed on the inside wall of the discharge means in abutting relationship to the exit end of the jet tube, said fillet being designed to present a smooth streamlined surface connecting the inside wall of the exit end of the jet tube with the inside wall of the discharge means.

10. The jet device of claim 9 which includes means for applying a liquid addendum to the filter tow as it passes through the jet device.

11. The jet device of claim 10 wherein the means for applying a liquid addendum comprises an injection probe disposed within the jet tube of said jet device.

12. The jet device of claim 9 which includes a porous, cylindrical sleeve axially aligned with and attached to said discharge means for restricting radially outward movement of the filter tow as it emerges from the discharge means while allowing at least a portion of the gaseous fluid to escape through said sleeve.

* * * * *